United States Patent [19]

Muylle

[11] 3,943,810

[45] Mar. 16, 1976

[54] ROTARY PERFORATING APPARATUS

[75] Inventor: Wilfried Edgard Muylle, Schoten, Belgium

[73] Assignee: AGFA-GEVAERT N.V., Mortsel, Belgium

[22] Filed: Aug. 2, 1974

[21] Appl. No.: 494,337

[30] Foreign Application Priority Data

Aug. 3, 1973 United Kingdom ..... 36897/73

[52] U.S. Cl. ..... 83/337; 74/116; 74/118; 83/100; 83/698; 234/50

[51] Int. Cl.[2] ..... B26D 1/56

[58] Field of Search ..... 83/337, 338, 100, 698; 234/50; 74/116, 118

[56] References Cited

UNITED STATES PATENTS

| | | | |
|---|---|---|---|
| 2,760,576 | 8/1956 | Spencer | 83/100 |
| 2,963,932 | 12/1960 | Glueck | 83/337 |
| 2,984,138 | 5/1961 | Vitense et al. | 83/337 X |
| 3,661,044 | 5/1972 | Duden et al. | 83/337 X |
| 3,763,729 | 10/1973 | Ashby | 83/698 X |

*Primary Examiner*—Donald R. Schran
*Assistant Examiner*—W. D. Bray
*Attorney, Agent, or Firm*—William J. Daniel

[57] ABSTRACT

A rotary perforating apparatus for forming the guide perforations in photographic film, wherein the mechanism which controls the movements of the punch carrier arms comprises a control disc which rotates eccentrically with respect to a film-supporting wheel, and wherein the punch carrier arms are connected to said control disc through control arms which may perform a spacial swinging movement, thereby to provide a mechanism which is little subject to wear, and wherein standard ball bearings and ball joints may be used.

7 Claims, 4 Drawing Figures

ROTARY PERFORATING APPARATUS

Figure 1:
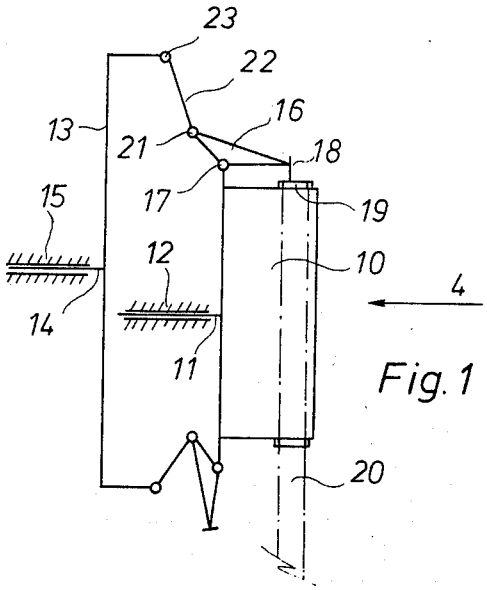

The present invention relates to a rotary perforating apparatus for perforating a travelling web. The invention is primarily intended for embodiment in apparatus for forming the guide perforations in photographic film and the like.

The perforating of photographic film is necessarily a precise operation in that close tolerances must be maintained for the reason that correct travel of the film is possible only when there is exact registration and engagement of the teeth of sprocket wheels with the perforations in the film. Economy in manufacturing practice requires that film perforation be accomplished at high speeds, say greater than 100 m/min, and therefore perforating apparatus of the rotary type has been developed which comprise a plurality of individual perforator assemblies, each including a pivotal punch carrier arm and a die, disposed side-by-side in a series around the periphery of a rotatable web supporting wheel, said cam means for controlling the movement of the punch carrier arms so that during rotation of said wheel the punch carrier arms of the successive assemblies are displaced towards the web-supporting wheel to cause a web passing through the apparatus to be perforated at successive positions along its length by the punch elements on said carriers.

The cam means constitute a serious problem in the proper operation of the described apparatus.

In the case the cam means have the form of a stationary disc which is provided with a recessed cam path wherein rollers may roll which are fixed either directly, or indirectly through the intermediate arm, to the punch carrier arms so as to control the position of the punch carrier arms by their bodily displacement, as disclosed for instance in United Kingdom Pat. No. 1,314,163 filed May 9, 1969 by Gevaert-Agfa N. V. it is shown that the rollers are subject to appreciable wear. This increased wear is not at all surprising if one considers the fact that the speed of these rollers may easily exceed 200 revolutions per minute for 150 revolutions per minute of the web-supporting wheel, and that during each revolution of the web-supporting wheel the direction of rotation of the rollers is reversed twice as a consequence of the rolling of the rollers on the outer and the inner wall of the cam groove alternately as the punch carrier arms move alternately towards and away from the web supporting wheel. The biasing of the punch carrier arms, by means of springs so that the rollers which control their movement always roll on the same wall of the cam groove raises considerable difficulties, since springs for effecting such biasing must necessarily have a rather great number of turns in view of the important displacement of the punch carrier arms to warrant a sufficiently long life time of such springs. Springs of the required size cannot be incorporatd in the usual type of rotary perforating apparatus, unless the dimensions of the cam control mechanism are increased to offer sufficient space for the mounting of such springs.

The punch carrier arms can be displaced by a cam ring which rotates with and at the same angular speed as the web-supporting wheel, but is eccentric with respect to such wheel. In that case the problem of excessive wear between a cam and cam-follower rollers on the punch carrier arms does not arise. An apparatus employing a rotatable cam ring and web-supporting wheel one of which is mounted eccentrically with respect to the other is disclosed in U.S. Pat, No. 2,760,576 of Dudley W. C. Spencer issued Aug. 28, 1956. In the nature of the design of that apparatus the clearance between the dies and the punches when the punches are in the retracted position, is very limited so that the web must be transversely bowed in order to become properly located on the web-supporting wheel. High-quality light-sensitive photographic material does not allow such distortion and thus the punch carrier arms should be fully withdrawn in order to avoid any substantial torsion of a web about its longitudinal axis. If the degree of eccentricity between the cam disc and the web-supporting wheel were to be increased, that would permit a greater displacement of the punch carrier arms to be obtained. However, the punch carrier arms are in the form of flexible metal blades each of which becomes progressively flexed bby direct bearing contact of the cam ring therewith to cause the punch to pass through the web. There is some relative sliding movement between the blades and cam ring during such flexure and if the degree of eccentricity were to be increased as referred to the frictional contact would be greater. Moreover such an increase in eccentricity would reduce the period of time, or in other terms the angular displacement of the web-supporting wheel, which is available for the punches to engage the web for the perforation theroef. The problem is accentuated by the fact that in contrast to a control of the displacement of the punch carrier arms by means of a stationary cam member in which there is almost complete freedom on the design of the cam track or profile, when control is exercised by a disc which rotates with the perforator wheel there is no such freedom of choice of the cam track or profile since each point on the disc follows a truly circular path. The only parameter which may independently be varied in the eccentricity between the axes of the web perforator wheel and of the disc controlling the punch carrier arms. An increase of the eccentricity decreases the angular displacement of the web-supporting wheel during which the punches effect perforation of the web.

The object of the present invention is to provide a rotary perforating apparatus in which the displacements of the punch carrier arms are positively controlled by control means which rotates with the web-supporting wheel; and in which the clearance available for the movement of the web onto and off the web-supporting wheel can be made adequate to avoid any necessity for the web to be bowed, without involving problems of friction in the control mechanism. The invention can be carried out using standard ball bearings or ball joints for the pivotal connections in the control mechanism for the punch carrier arms.

In accordance with the present invention, a rotary perforating apparatus for performing a travelling web comprises a frame in which a rotatable web-supporting wheel is mounted for supporting part of a web during its advance through the apparatus in contact with such wheel, a plurality of web perforator assemblies, each including a punch carrier arm pivoted in a radial plane of the wheel and a die, such assemblies being disposed side-by-side in a series around the periphery of said wheel, and means which during rotation of said wheel cause the punch carrier arms of the successive perforator assemblies to be swung towards the web-supporting wheel to cause a web passing through the apparatus to be perforated at successive positions along its length by punch elements on said carrier arms, such means comprising a member mounted for rotation with and at the same angular speed so that of the web-supporting wheel, and a control arm for each of the punch carrier arms, each said control arm being pivotally connected at one end to said member and at the opposite end to the corresponding punch carrier arm, the points of pivotal connection of said control arms to said member being disposed on a notional circle which is eccentric with respect to said web-supporting wheel.

It is convenient for the member to which the said control arms are pivoted to be a circular disc or the like member to which the said arms are pivoted at points located at or near its periphery. For convenience in description the said member will hereafter be referred to as the control disc but the member need not be in the form of a disc.

The reduced wear of the means which control the operation of the punch carrier arms in the apparatus according to the invention is caused thereby that the connection of the control arms with the control disc and the punch carrier arms occurs via pivotal connections. Such connections afford a very positive control of the movement of the punch carrier arms. Preferably such connections carry out angular displacements which are not greater than about 20° between the extreme positions, this as distinct from known rollers which engage successively one or the other of two opposite walls of a cam groove, and which have to rotate at speeds exceeding 2000 revolutions per minute.

The ends of the control arms which are connected to cam disc perform a rotating movement, as seen from the web-supporting wheel, in a plane which is normal to the axis of the cam disc, rather than a linear movement which is radial with respect to the web-supporting wheel. The radius of this circular movement equals the eccentricity of the cam disc in respect to the web-supporting wheel.

The opposite ends of the control arms perform a movement in a radial plane of the web-supporting wheel as a consequence of their connection to the punch carrier arms.

The period of time during which a punch engages the web should be preferably so long that in the operation of the apparatus, the web is engaged by the punch or the punches of at least one punch carrier arm at a time. In the absence of such engagement the punch or the punches of one punch carrier arm may not yet have contacted the web as the punch or the punches of the adjacent carrier arm have retracted already from the web after the perforation. A lapse of time would thus exist during which no punch would engage the web and under such conditions it is difficult to obtain an accurate web perforation. Thus, the punch or the punches of at least one punch carrier arm should at any time engage the web on the web-supporting wheel and whereas such engagement does not necessarily involve that the punches should be completely depressed so as to enter the corresponding holes of the die, they preferably engage the web over the complete thickness of said web.

Figure 4:
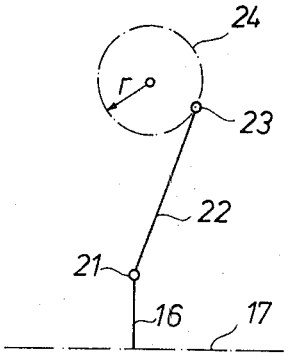
Figure 3:
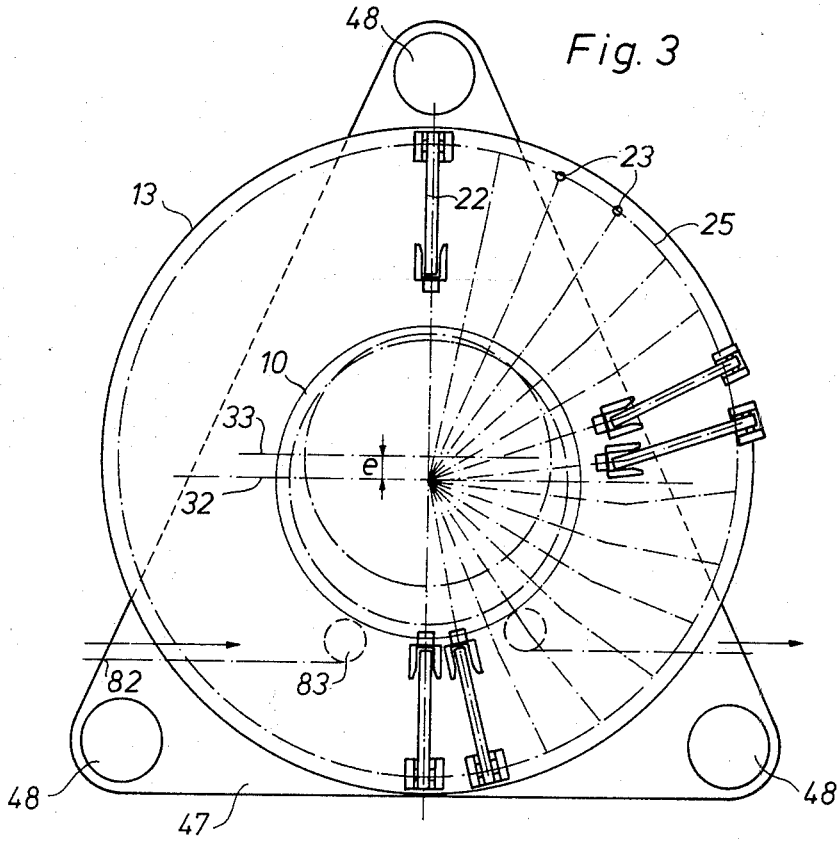
Figure 2:
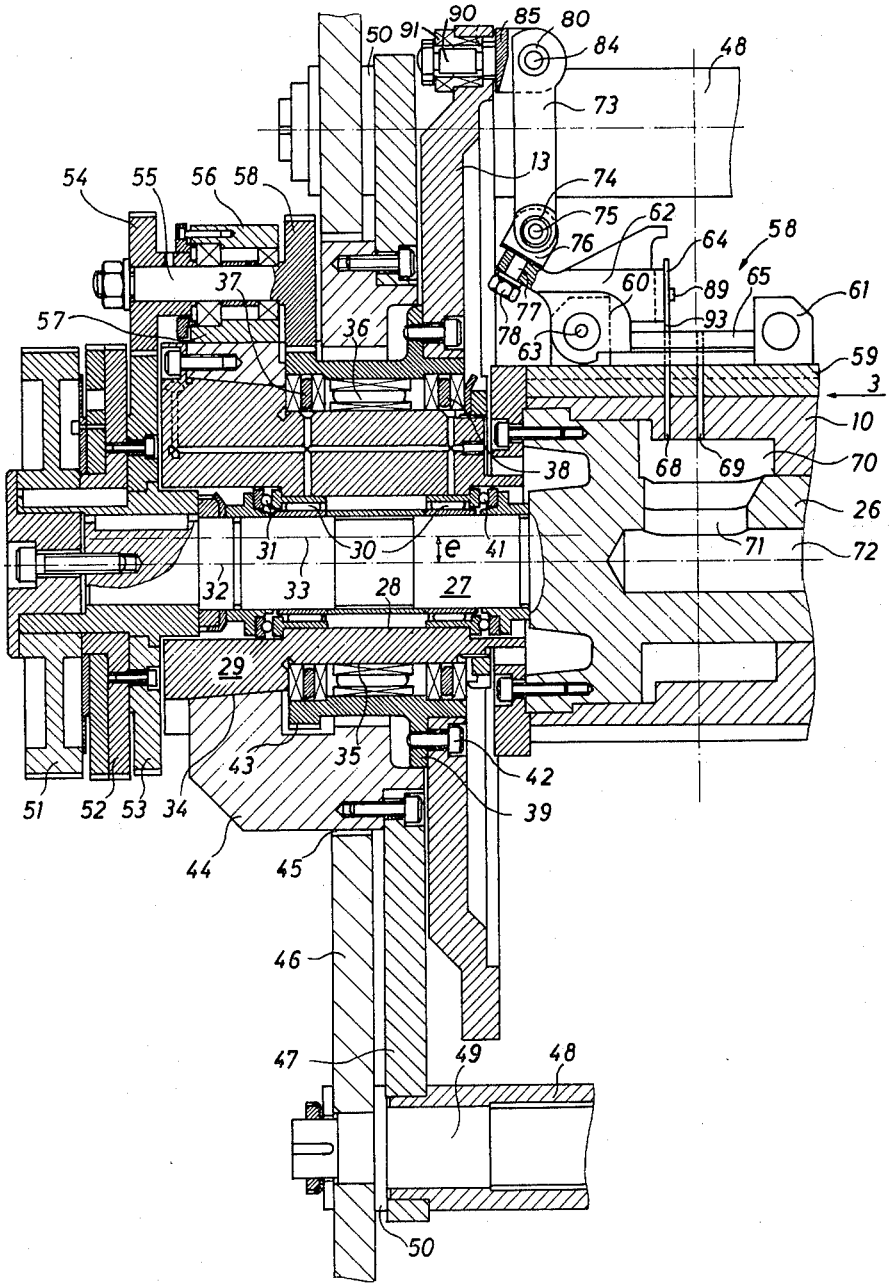

The invention will now be described hereinafter by way of example with reference to the accompanying drawings, wherein:

FIG. 1 is a diagrammatic illustration of an apparatus according to the present invention, FIG. 2 is a detailed sectional view of an apparatus taken in a plane which comprises the axes of both the control disc and the web-supporting wheel, FIG. 3 is a diagrammatic front elevational view according to the arrow 3 of FIG. 2, illustrating the swinging movement of the control arms of the punch carrier arms, FIG. 4 is a diagrammatic illustration of an arrangement which illustrates the swinging movement of a control arm.

The apparatus which is diagrammatically illustrated in FIG. 1 comprises a wheel 10 which is fixedly attached to a shaft 11 rotatable in a bearing 12, and a control disc 13 which is fixedly attached to a shaft 14 rotatable in a bearing 15. The wheel 10 is provided along its periphery with a plurality of closely angularly spaced perforator assemblies, each comprising a punch carrier arm 16, represented by a triangle in the figure, and a cooperating die 19. Each arm 16 is arranged for pivotation in a radial plane of the wheel round a pin 17, whereas the corresponding dies 19 are fixedly attached to the circumference of the wheel 10. The arms 16 carry at one extremity the punches 18 which cooperate with holes in the dies 19 to perforate a web which is conveyed over the wheel along a path 20 indicated in dash and dot lines.

The opposite end of each punch carrier arm 16 is pivotally connected at a point 21 to one end of a control arm 22, the opposite end of each such control arm being pivotally connected to the control disc 13 at a point 23. The points 23 are spaced from each other over angular intervals that equal the angular spacing between the successive perforator assemblies and that are located on a circle 25 that centre of which coincides with the axis of the control disc 13, see FIG. 3. For the sake of clarity the points 23 have been illustrated somewhat remote of the control disc 13 in FIG. 1 but it should be understood that they are points which actually occupy a fixed position on the control disc 13.

Means is provided, not shown in simplified FIG. 1, for rotating the control disc and the web-supporting wheel at equal angular speeds and it may be seen that a punch carrier arm 16 moves from its operative position, shown at the upper part of the figure, to its inoperative position, shown at the lower part of the figure, as the wheel 10 and the control disc 13 are rotated over 180 angular degrees.

Referring to FIGS. 2 and 3, the perforating apparatus comprises a web-supporting wheel 10 which is fitted on a widened portion 26 of a shaft 27, e.g. by means of heat-shrinking. The shaft is rotatably journalled in a bore 28 in a generally cylindrical stationary bearing block 29 through radial needle bearings 30 and axial thrust ball bearings 31 and 41. The axis of the bore and of the shaft is indicated by the dash and dot line 32 and it may be seen that this axis is eccentric over a distance *e* with respect to the axis of the bearing block 29 which is indicated by dash and dot line 33. The bearing block 29 has a conical portion 34 and a cylindrical portion 35, both portions having as common axis the axis 33.

Through radial needle bearings 36 and axial thrust bearings 37 and 38 the cylindrical portion 35 rotatably suports a bushing 39 to which at one end a control disc 13 is fitted by means of socket screws such as the screw 42 illustrated. The opposite end of the bushing 39 is provided on its periphery with an elevated rim portion which is provided with gear teeth 43. For the ease of the further description these gear teeth will be called the gear 43 of the control disc 13.

The conical portion 34 of the bearing block is pressed in a corresponding conical opening in a supporting element 44 which is generally cylindrical, except for a small flat portion at the upper side which will be described later, and extends through a circular opening 45 of the stationary machine frame 46. The supporting element 44 is fixedly attached by socket screws (not numbered in the figure) to an upstanding wall 47 of generally elongate triangular shape, see FIG. 3. The upstanding wall 47 is fitted to the machine frame 46 by means of three bushings 48 and cooperating stud screws 49 with rings 50. The bushings 48 and the stud screws 49 serve equally to fit a wall opposite to the wall 47. Said opposite wall may be identical to the triangular wall 47 and may comprise parts for supporting the right-hand half of the web-supporting wheel and the corresponding control disc, not shown in the drawing. Said further parts may be identical to the parts described already hereinbefore, and therefore they need no further attention in the present description.

The shaft 27 of the web-supporting wheel 10 is provided at its left-hand extremity with gear wheels 51, 52 and 53. The gear wheel 51 is intended for cooperation with a timing belt or the like for driving roller parts, not shown in the drawing, for pulling the web with a predetermined tension from the web-supporting wheel. The gear wheel 52 meshes with a driven gear wheel for rotation of the apparatus. The gear wheel 53 meshes with a pinion 54 fitted to a shaft 55 that is rotatably journalled in a bearing block 56. The bearing block 56 has a flat base 57 and is fitted therewith to the flat portion of the upper side of the supporting element 44 described hereinbefore. A second pinion 58 which is provided at the opposite extremity of the shaft 55 meshes with the gear wheel 43 of the control disc 13. The gear ratio between gear wheel 53 and pinion 54 equals that between gear wheel 43 and pinion 58 so that the angular speeds of the web-supporting wheel 10 and of the control disc 13 are necessarily equal.

The web-supporting wheel 10 is provided with a plurality of perforator assemblies on its periphery, spaced at equal angular intervals. Each perforator assembly comprises a die base member 59 which is provided with parallel upstanding end portions 60 and 61 between which a punch carrier arm is pivotally journalled, such as the left-hand arm 62 shown which may pivot on a pin 63 in a radial plane of the wheel 10. Each punch carrier arm carries at one end a punch element 64 which is provided at one end (or at each end in which case the element is made reversible) with one or more punch pins 93 which may cooperate with the corresponding holes in a die 65 which fits into the die base member 59. The die holes communicate through bores 68 and 69 in a preforator assembly and in the periphery of wheel 10 with a ringlike chamber 70 in the wheel for the removal of the punched-out slugs through a radial passage 71 and an axial passage 72 in the wheel shaft. The dies may further be provided with a central recessed portion wherein an underpressure may be maintained for securing a firm adhesion of the film to the dies, but since these details as well as other details relative to the construction of the perforator assemblies and the fitting of these assemblies to the web-supporting wheel are not relevant to the gist of the present invention, reference should be taken to the prior art literature in particular United Kingdom Pat. No. 1,314,163 filed May 9, 1969 by Gevaert-Agfa N. V. for further details of these subjects.

The control of the operation of the perforator assemblies occurs as follows.

Each punch carrier arm 62 is connected with its end opposite to the end supporting the punch elements to a control arm 73. This connection occurs through a ball-joint 74, the outer ring of the ball-joint being pressed in a corresponding bore in the arm 73, the inner ring of the coupling being connected by a pin 75 between upstanding wall portions of a forked member 76. At its lower end, said forked member has a stud 77 that passes through a corresponding bore in the end of the punch carrier arm and that is fixedly attached by means of a nut 78.

The opposite ends of the control arms 73 are pivotally connected to the control disc 13 at positions which are spaced at equal angular intervals, and which are situated on a circle as mentioned already hereinbefore.

The pivotal connection of each said opposite end of a control arm to the control disc occurs by meanas of a forked member 85 which has a stud 90 mounted for pivotation by means of a bearing 91 about an axis which runs parallel with the axis 33 of the control disc, and which has also a pin 84, the axis of which is normal to said first axis, and about which the arm 73 may pivot by means of a bearing 80.

The bearing 80 is a conventional radial ball bearing whereas the bearing 91 is a combination of a radial and a thrust bearing.

Referring to FIGS. 2 and 3, the operation of the apparatus is now described for the case of a clockwise rotation of the web-supporting wheel, although it will be understood that operation in the reverse direction is equally feasible if the direction of feed of the web is reversed. The web to be perforated in a light-sensitive photographic film on a triacetate base with a width of 16 mm, which must be provided at either edge with edge perforations.

The diameter of the circular periphery on which the film is supported amounts to about 218 mm. Thirty perforator assemblies are provided on the wheel. Each perforator assembly has two punch carrier arms and one common die, and each of the punch carrier arms supports a punch element with three parallel punch pins which in their operative positions are located in a plane which is normal to the axis of the wheel. The wheel 10 and the control disc 13 are driven at a constant speed through driving wheel 52. The film 82 is fed to the wheel over rollers which are braked through a slip clutch so that a constant film tension is secured. In the same way, the film is pulled from the wheel by rollers driven via a slip clutch by the gear wheel 51 so that a constant web tension may be obtained. The unperforated film 82 enters the apparatus in the vicinity of the 7 o'clock position (FIG. 2) by conveyance around a guide roller 83 shown in broken lines and journalled in the framework of the apparatus with its axis running parallel to the axis of the wheel 10. The punch carrier arms in the reach of this guide roller are in fully retracted position and thus the film is led onto the surface of the die elements on the wheel without interferences from such arms.

The film contacts the dies at about the 8 o'clock position and follows the wheel periphery until about the 5 o'clock position where the film looses contact with the wheel and is led to a winding devices, not shown.

The punch elements are in fully depressed position by the time the 12 o'clock position is reached, the operative stroke of the punch carrier arms taking place from the 8 to the 12 o'clock position, the the retracting stroke occurring from the 12 to the 4 o'clock position. The angular displacement of the wheel during which a punch is engaging the film amounts from 9.5° before to 9.5° after the 12 o'clock position of the wheel, whereas the angular wheel displacement during which a punch completely extends through the film amounts to 13 degrees, i.e. 6.5 degrees before and 6.5 degrees after the 12 o'clock position.

Considering the fact that each punch carrier arm covers 12° of the periphery of the web-supporting wheel since there are 30 perforator assemblies for 360 angular degrees, it may be seen that the machine fulfills the condition that at any given time the punch or the punches of at least one punch carrier arm engage(s) the web preferably through the complete thickness of the web.

The described punch movement results from the swinging movement of the control arms. The movements comprise a swinging of the inner ends of the arms in a radial plane of the wheel as illustrated in FIG. 1, and a swinging movement of the outer ends of the arms in a plane which is normal to the axis of the control disc as illustrated in FIG. 2.

The movement of the outer ends of the control arms 22 is the most curious of both movements, and it may be shown that during each orbit of a point 23 of a control arm 22 around the axes of the control disc and the web-supporting wheel, such control arm end traces with respect to the pivotal axis of the punch carrier arm, a perfectly circular path about an orbiting axis in a plane normal to the axis of the wheel. The circular path is spatially fixed in relation to the pivotal axis of the appertaining punch carrier arm (i.e. axis 17 in FIGS. 1 and 4 and the axis of pivot pin 63 in FIG. 2). This is illustrated in FIG. 4 which is a diagrammatic view in the direction of the arrow 4 in FIG. 1, and wherein the circle 24 drawn in dash and dot lines represents the movement of a point 23 on the control disc 13 to which the end of a control arm 22 is connected, relative to the pivotal axis 17 of the associated punch carrier arm 16, during one revolution of the web-supporting wheel. The radius $r$ of the circle 24 corresponds with the eccentricity $e$ between the axes 32 and 33 of the web-supporting wheel end of the control disc.

The adjustment of the perforation depth, that is the greatest distance over which the punches may enter the dies, may individually occur by adjusting the vertical position of the punch elements 64 on the punch carrier arms 62 by loosening the socket head screws 89, see FIG. 2 as known in the art. A much smoother control of the perforation depth is obtained, however, if the pins 84 of the rotational connections of the control arms 73 are arranged for slight parallel displacement. The control of this displacement of the rotational axis may occur in a very simple form if each pin 84 will support the inner ring of a radial ball bearing 80 has a cylindrical portion the axis of which is offset with respect to the general axis of said pin. If each pin is mounted for rotation round its general axis in the member 85, then the position of the inner ring of the radial ball bearing which is supported on such offset cylindrical portion of the pin, may be adjusted by rotation of such pin, and a rotation of the pin 84 over 180 angular degrees may permit an adjustment of the perforation depth over a total course of some tenths of a millimeter.

The adjustment of the perforator assemblies on the wheel 10 may be based on the mating of very accurately machined groove and tongue arrangements in cooperating parts as known in the art, but it is also possible to obtain the same and often even a greater accuracy of perforation, if the position of the different elements, which may be the cause of inaccurate perforations, may be individually adjustable under a microscope by means of push and pull screws or through the intermediary of wedges which may be displacable by such push and pull screws.

In the operation of the apparatus according to the present invention, it was shown that perforation could continue for many thousands of hours without any substantial wear of the parts of the mechanism which control the operation of the punch carrier arms.

Whereas rotary perforating apparatus of the type comprising rollers which cooperate with a stationary cam track, such as disclosed in the patent mentioned hereinbefore, start to get very noisy for web speeds greater than about 120 m/min mainly as a consequence of the intermittent contact of the rollers with the walls of the cam track, the apparatus according to the present invention produces no substantial noise, except for the noise produced by the operation of the punches, and this for speeds which exceed a web speed of 150 m/min.

It will be understood that the present invention is not limited to the described embodiment. The apparatus may comprise one series of punch carrier arms rather than the two series of arms described hereinbefore. Such one series of punch carrier arms may carry two punches or two sets of punches spaced in the axial direction of the wheel so that one series of arms may yet produce two rows of perforations in a web.

Each punch element may comprise three punches which simultaneously pierce the web. Alternatively each punch element may be provided with only one or two punches which act simultaneously if the mutual spacing of the perforations on the web or the sufficiently close mounting of the perforator assemblies on the wheel allow such reduction of the number of punches per element.

The pivotal connection of the control arms at their inner ends may also occur by means of two radial bearings as shown for the connections of the outer ends to the control disc, rather than by a ball joint. A coupling of both ends of the control arms by means of a ball joint may give unsatisfactory results since in such case the arm is also free to rotate on its longitudinal axis and thereby its end portions may strike portions of the forked members to which the outer rings of such ball-joints are fitted.

The apparatus may also be driven via the control disc, rather than via the web-supporting wheel, and the rotational coupling of both rotatable elements may also occur by sprocket wheels and chains, timing belts or the like.

We claim:

1. Rotary perforating apparatus for perforating an advancing web, comprising a frame, a rotatable web-supporting wheel mounted on said frame for supporting a section of the web during its advance, a plurality of web punch assemblies, each including a punch carrier arm pivoted in a radial plane of the wheel, a punch on said arm, and a die for receiving said punch, arranged in spaced side-by-side relation in series around the periphery of said wheel, said means operative during rotation of said wheel to pivot the punch carrier arms of the successive perforator assemblies towards the web-supporting wheel to perforate successive sections of the web supported on said wheel, said means comprising a control member mounted on said frame for rotation with and at the same angular speed as the web-supporting wheel, and a control arm for each web punch assembly, each control arm being pivotally connected at one end to said control member and at the opposite end to the corresponding punch carrier arm, the points of pivotal connection of said control arms to said control member being arranged in a circle which is eccentric with respect to the axis of rotation of said web-supporting wheel.

2. Rotary perforating apparatus according to claim 1, wherein each said control arm is connected to said control member through a first coupling permitting rotation of such arm about a first axis which runs parallel with the axis of rotation of such member, and through a second coupling permitting rotation of such arm about a second axis which is normal to such axis of rotation.

3. Rotary perforating apparatus according to claim 2, wherein means is provided for individual slight adjustment of the position of said second axis.

4. Rotary perforating apparatus according to claim 1, wherein each said control arm is pivotally connected to the corresponding punch carrier arm occurs through a ball-joint.

5. Rotary perforating apparatus according to claim 1, wherein said web-supporting wheel and said control member are both rotatably mounted with respect to a common stationary and generally cylindrical bearing member, the control member being rotatably journalled on the outer periphery of said bearing member and the web-supporting wheel being rotatably journalled in a bore in said bearing member, the axis of said bore being offset with respect to the axis of said cylindrical bearing member.

6. Rotary perforating apparatus according to claim 1, wherein the control member and the web-supporting wheel are provided with gear wheels meshing with rotational coupling means to drive the control member and the web-supporting wheel at said equal angular speeds.

7. Rotary perforating apparatus according to claim 6, wherein said couplinlg means comprises a shaft which is freely rotatable about a final axis, and two pinions fixedly attached to said shaft, one pinion meshing with the gear wheel of the control member and the other pinion meshing with the gear wheel of the web-supporting wheel, the gear ratios between the pinions and the corresponding gear wheels being equal to each other.

* * * * *